US008051883B2

(12) United States Patent
Gibisch

(10) Patent No.: US 8,051,883 B2
(45) Date of Patent: Nov. 8, 2011

(54) INDUSTRIAL CONTAINER FILLING LANCE

(76) Inventor: Glenn J. Gibisch, Downers Grove, IL (US)

( * ) Notice: Subject to any disclaimer, the term of this patent is extended or adjusted under 35 U.S.C. 154(b) by 397 days.

(21) Appl. No.: 12/382,615

(22) Filed: Mar. 19, 2009

(65) Prior Publication Data

US 2010/0236661 A1 Sep. 23, 2010

(51) Int. Cl.
*B67C 3/34* (2006.01)

(52) U.S. Cl. ..... 141/279; 141/376; 239/281

(58) Field of Classification Search ..... 239/275, 239/280–281; 141/279, 374, 376
See application file for complete search history.

(56) References Cited

U.S. PATENT DOCUMENTS

| | | | | |
|---|---|---|---|---|
| 2,548,611 | A | 4/1951 | Maslin | |
| 3,061,201 | A * | 10/1962 | Rienecker | 239/281 |
| 3,920,056 | A | 11/1975 | Piecuch | |
| D260,816 | S | 9/1981 | Zissimopoulos et al. | |
| 4,570,854 | A * | 2/1986 | Wernhart | 239/745 |
| 4,615,487 | A * | 10/1986 | O'Brien et al. | 239/281 |
| 4,807,837 | A | 2/1989 | Gawlik et al. | |
| 4,892,279 | A | 1/1990 | Lafferty et al. | |
| 4,957,147 | A | 9/1990 | Lowe | |
| 5,445,352 | A | 8/1995 | Long | |
| 5,458,305 | A | 10/1995 | Woodward | |
| 5,860,410 | A | 1/1999 | Hollingsworth, Jr. | |
| 6,056,028 | A | 5/2000 | Crawford | |
| 7,237,758 | B2 | 7/2007 | Nikolic | |
| 2004/0011930 | A1 | 1/2004 | Tuohy, III et al. | |

FOREIGN PATENT DOCUMENTS

| | | |
|---|---|---|
| AU | 2005100609 | 9/2005 |
| FR | 2 626 345 | 7/1989 |
| WO | WO 93/00290 | 1/1993 |

OTHER PUBLICATIONS

Liquid fillers "on sale", by Specialty Equipment, 2 pages printed from the Internet Jan. 20, 2009. http://specialtyequipment.com/section.aso?product=Liquid%20Fillers&sec=l&qclid=COv-59Twm5qCFQECGgodgnfHmA.

Drum filling machine "on sale", by Preci-Tech Weighing System, 1 page printed from the Internet Jan. 20, 2009. http://www.preciweiah.com/drum-filling.html.

* cited by examiner

*Primary Examiner* — Christopher Kim
(74) *Attorney, Agent, or Firm* — Richard C. Litman

(57) ABSTRACT

The industrial container filling lance is an elongate pipe having a hose connector allowing connection of a hose from a fluid source to the lance, a ball valve for regulating flow of fluid through the pipe, and a fill spout for delivery of the fluid to an industrial container. The lance is disposed atop a hinged slide clamp attached to a telescoping lance support assembly, which extends vertically from a pedestal base. The elongate locking handle, rotated in the open position, allows the lance to be swung upward away from a fill container, and alternatively allows the lance to be longitudinally positioned precisely over a container to be filled. The elongate locking handle can be rotated over the lance to prevent movement of the lance during the container filling procedure. A rotating lock collar on the support stand assembly secures the support height while allowing angular rotation of the lance.

4 Claims, 5 Drawing Sheets

INDUSTRIAL CONTAINER FILLING LANCE

BACKGROUND OF THE INVENTION

1. Field of the Invention

The present invention relates to apparatus and methods for filling industrial containers with liquid, and particularly to an industrial container filling lance having an adjustable support.

2. Description of the Related Art

There are many designs for filling containers with liquid. Some of the most successful and efficient designs are those of the type having a tubular filling lance which is operatively connected to a source of liquid and which is vertically moveable by a power device between raised and lowered positions.

The lance is positioned above an opening in the container and lowered into the container for filling thereof. After the container is filled, the lance is returned to a fully raised and/or withdrawn position. For ease and efficiency of handling, two or more, frequently four, empty containers are placed on wooden pallets and moved along a conveyor to a filling station at which the filling lance is located. A major problem with these types of systems is the capital expenditure required to attain an automated lance and a compatible container delivering conveyor belt system. It would be desirable to have a much more cost efficient manually operated and portable lance that has height and rotational adjustment capabilities but that also can be locked into a user determinable position for safe delivery of the fluid to the container.

Thus, an industrial container filling lance solving the aforementioned problems is desired.

SUMMARY OF THE INVENTION

The industrial container filling lance is an elongate pipe having a hose connector that allows a hose from a vessel or pump to be connected to the lance, a ball valve for regulating flow of fluid through the pipe, and a fill spout for delivery of the fluid to an industrial container, tote, or the like. The lance is disposed atop a hinged slide clamp attached to a telescoping lance support assembly, which extends vertically from a pedestal base. The hinged slide clamp in the open position allows the lance to be pivoted upward away from a fill container, and alternatively allows the lance to be longitudinally positioned precisely over a container to be filled. The slide clamp can then be locked down to constrain elevational movement of the lance during the container filling procedure. A rotating lock collar on the support stand assembly secures the support height while allowing angular rotation of the lance.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
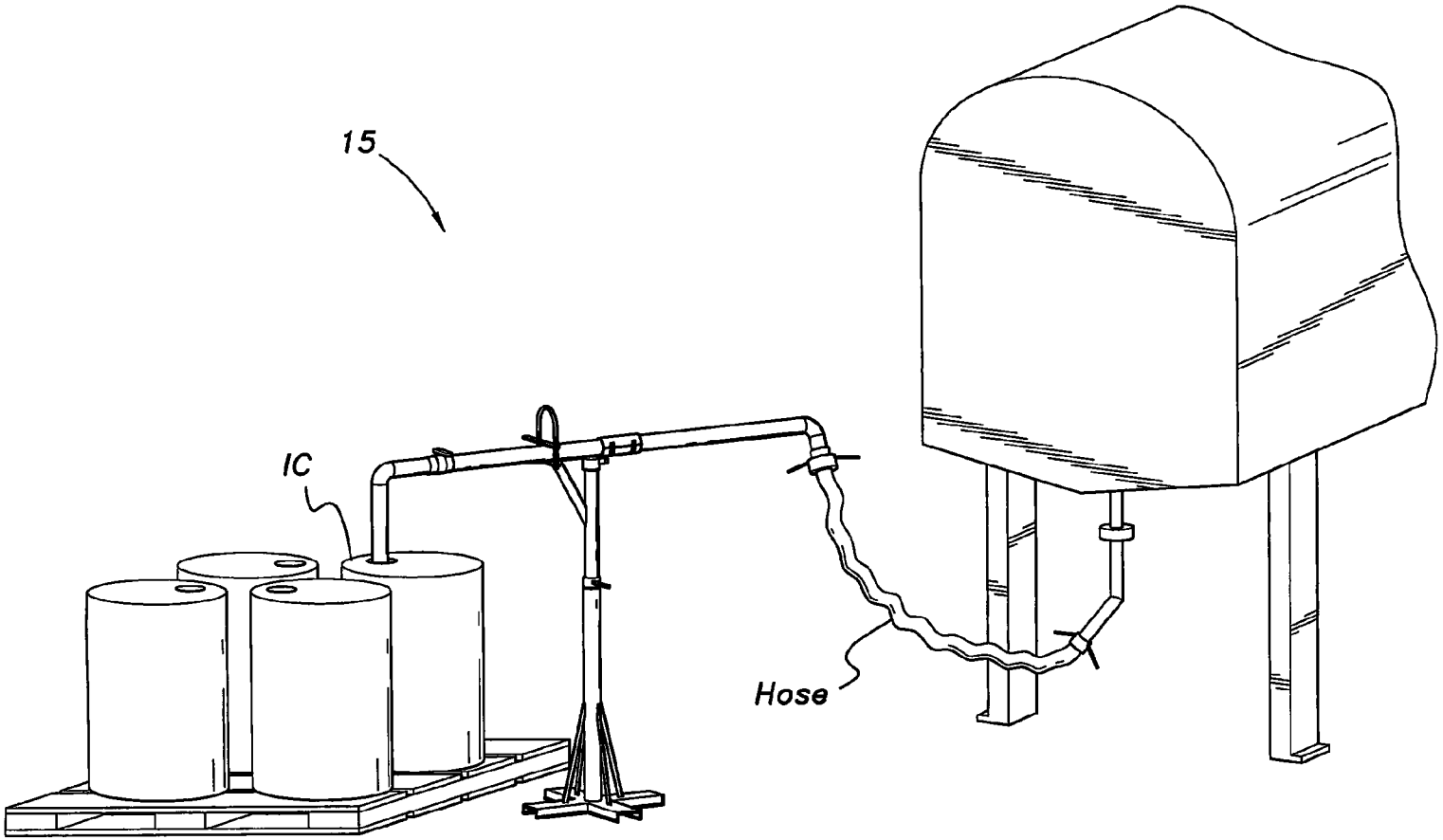
FIG. 1 is an environmental, perspective view of an industrial container filling lance according to the present invention.
Figure 2:
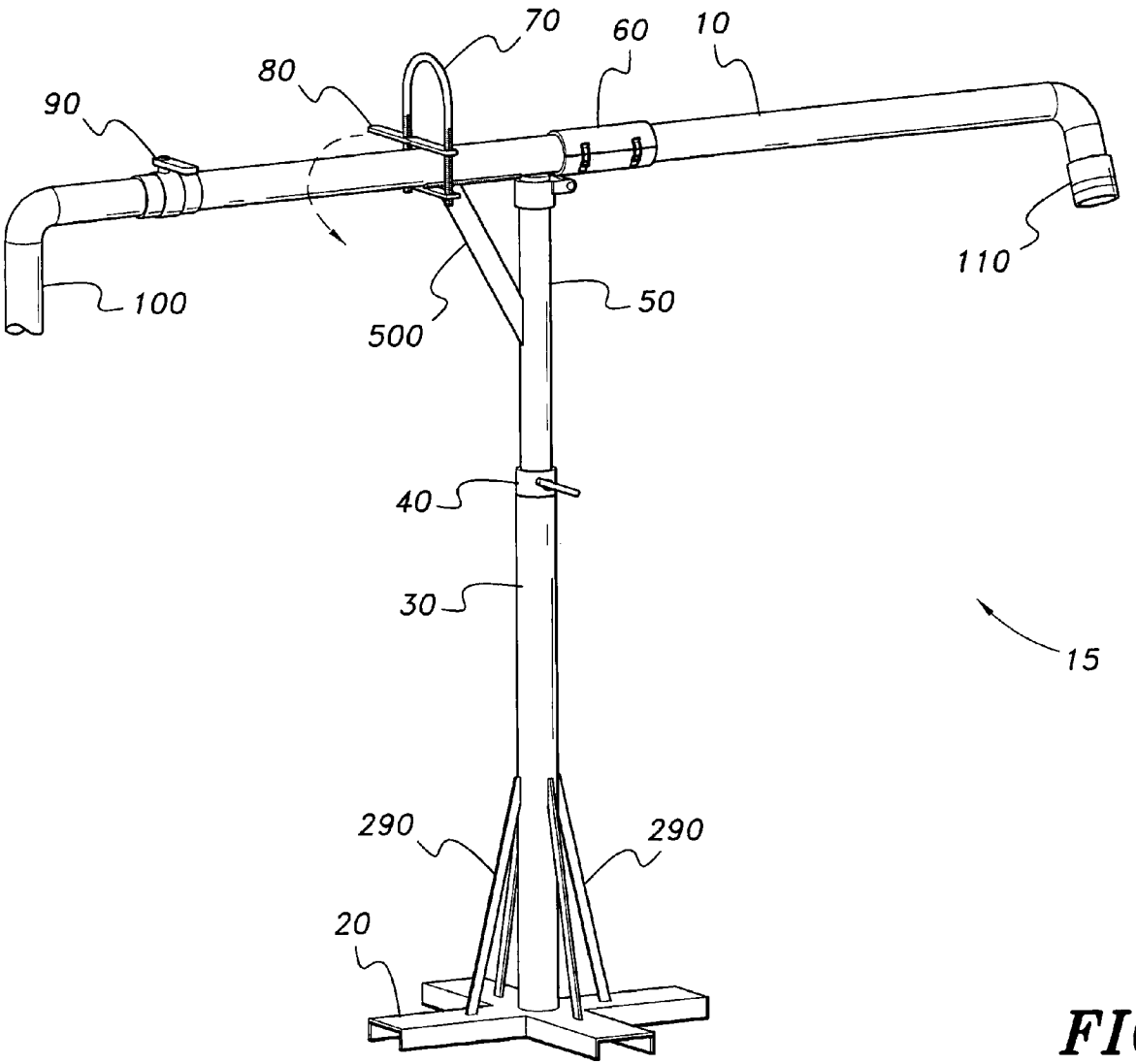
FIG. 2 is a perspective view of the industrial container filling lance of FIG. 1.
Figure 3:
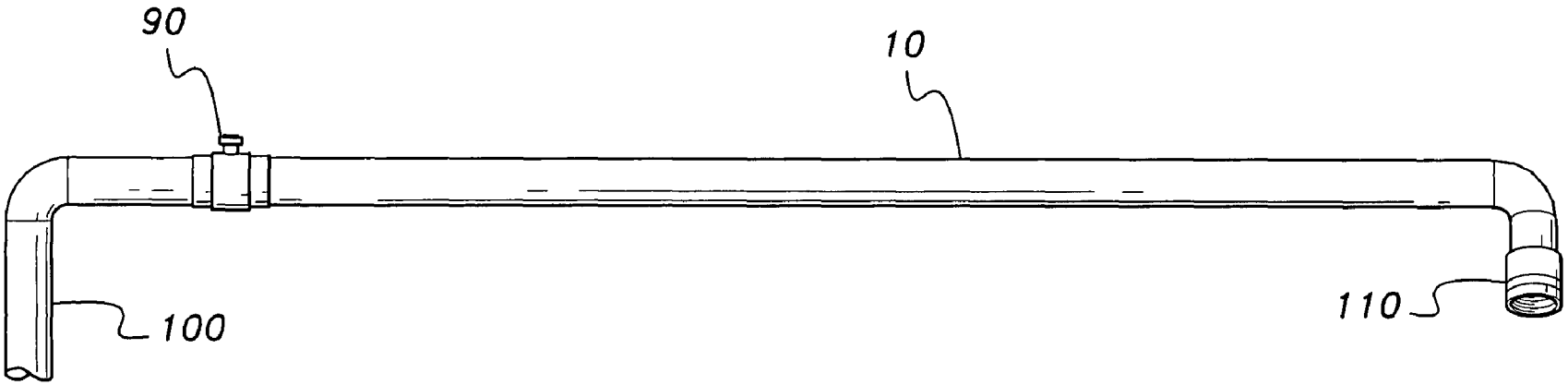
FIG. 3 is a side perspective view of the lance of FIGS. 1 and 2, shown without the support.

As shown in FIGS. 1-3, the industrial container filling lance, designated generally as 15 in the drawings, is comprised of a hollow elongate pipe forming a lance 10 having a hose connector 110 allowing a hose from a vessel or pump to be connected to the lance 10, i.e., the pipe, a ball valve 90 for regulating flow of fluid through the pipe 10, and a fill spout 100 for delivery of the fluid to an industrial container IC, tote, or the like. Ball valve 90 of lance 10 is manually operated and regulates fluid flow through the lance 10 and into an industrial container via the fill spout 100.

Figure 4:
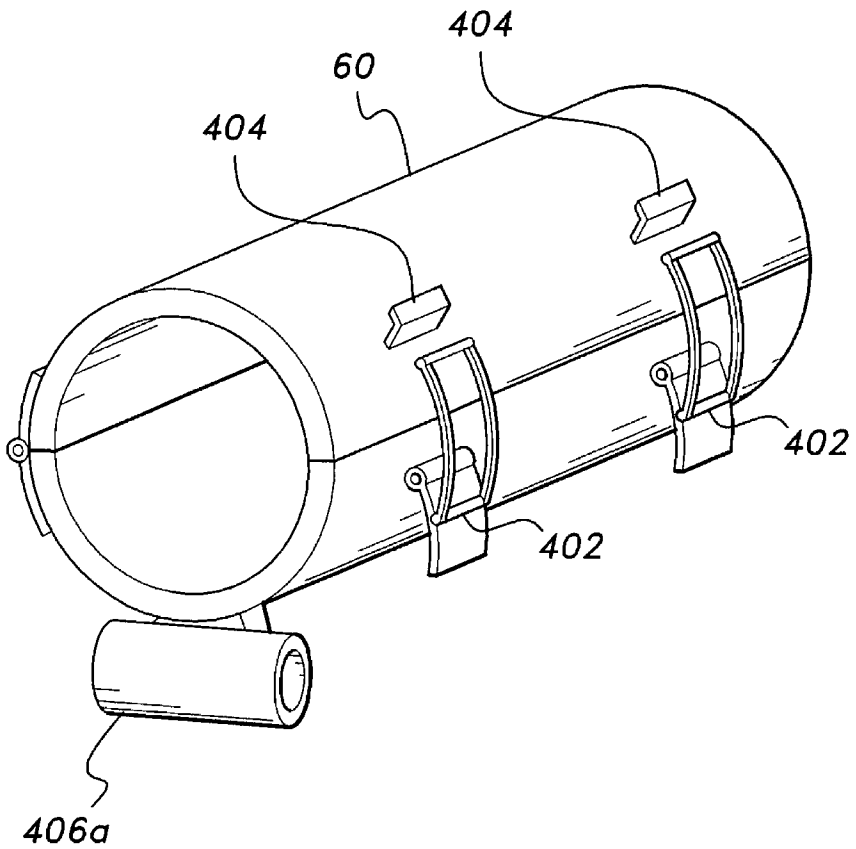
FIG. 4 is a perspective view of the hinge clamp of the industrial container filling lance of FIGS. 1 and 2.
Figure 5:
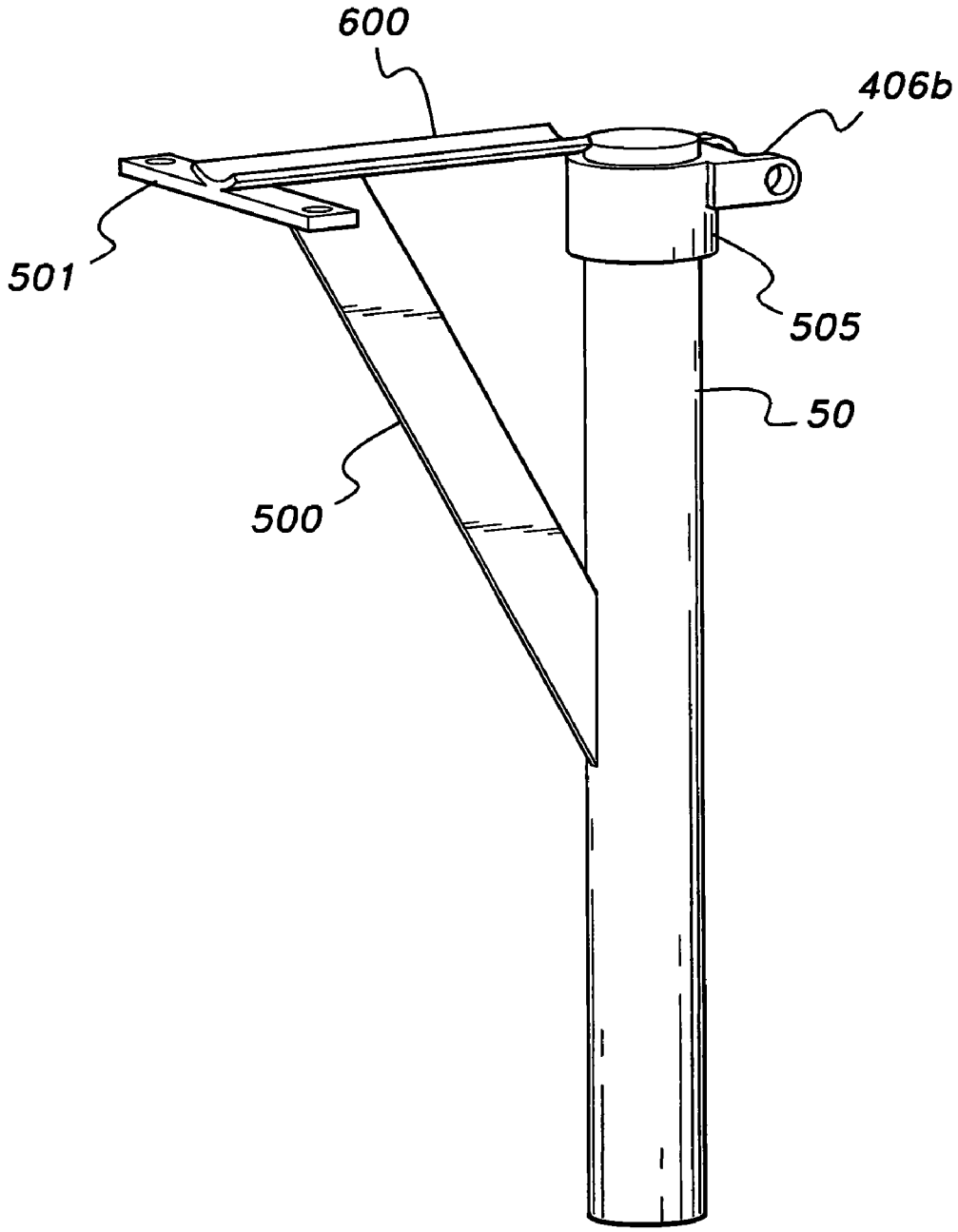
FIG. 5 is a side perspective view of the support and extender of the industrial container filling lance of FIGS. 1 and 2.

The lance 10 is disposed atop a hinged slide clamp 60 attached to a telescoping member 50 slidably adjustable within lance support member 30, which extends vertically from a pedestal base 20. As most clearly shown in FIG. 5, a cap 505 is disposed on top of telescoping member 50 and has a slide clamp attachment boss 406*b* having a pair of hinge cylinders aligned along a laterally extending axis. As most clearly shown in FIG. 4-5, a corresponding bushing 406*a* of slide clamp 60 is designed to align with and fasten to the hinge cylinders of slide clamp attachment boss 406*b* for secure attachment of the slide clamp 60 to the telescoping member 50. The slide clamp has a pair of buckle clasps 404 and buckles 402, which can lock hinged portions of clamp 60 to fully enclose periphery of lance 10 thereby locking the lance 10 into a horizontal configuration.

The pedestal base 20 is an X or cross shaped member that can stably rest on a support surface. Angled support braces 290 extend from the pedestal base 20 and attach to the support member 30.

The hinged slide clamp 60 in the open position allows the lance 10 to be removed from the support for cleaning or replacement. The slide clamp 60 can then be locked down to constrain elevational movement of the lance 10 during the container filling procedure.

A hose from a vessel or pump is connected to the hose connector 110 for the conveyance of fluid through the lance 10. A lock ring 40 secures the support height while being rotatable above support member 30 to allow angular rotation of the telescoping portion 50 supporting lance 10. The lance rests upon a longitudinally extending open lance support collar 600 which is attached to telescoping member 50 distal to and longitudinally aligned with the slide clamp 60. A collar brace 500 is welded to and extends upward from the telescoping member 50 at an approximately 45° angle to join and reinforce the lance support collar 600. Longitudinal reach of the lance 10 is adjustable via the hinged slide clamp 60. A threaded U shaped member 70 attaches an elongate locking handle 80 to secure lance 10 to the lance support collar 600 via U clamp attachment bracket 501 thereby clamping the lance 10 into a horizontal filling position. It should be understood that when the elongate locking handle 80 is horizontally rotated allowing vertical pivoting of the lance 10, the U shaped lock stop 70 constrains independent yaw motion of the lance 10 thereby allowing a user to safely swing the lance 10 vertically away from a container that has been filled or toward a container waiting to be filled.

The adjustable design allows an operator to manually fill two separate pallets of containers or totes side-by-side without interruption to reposition or handle the containers or use a conveyor system.

It is to be understood that the present invention is not limited to the embodiment described above, but encompasses any and all embodiments within the scope of the following claims.

I claim:

1. An industrial container filling lance, comprising:

a base;

a height adjustable support member vertically extending from the base, wherein said height adjustable support member has opposed upper and lower ends;

a horizontally disposed support collar secured to the upper end of the height adjustable support member and extending outwardly therefrom, said horizontally disposed support collar having an upper concave surface;

a collar brace extending between a lower surface of said horizontally disposed support collar and said height adjustable support member for supporting said horizontally disposed support collar;

a cap mounted on the upper end of said height adjustable support member, wherein a slide clamp attachment boss is mounted on said cap opposite said collar brace and said horizontally disposed support collar, said slide clamp attachment boss including a pair of axially aligned hinge cylinders;

a filling lance having a hose connector at one end thereof, and a fill spout at an opposite end thereof, wherein a lower external surface of said filling lance is received within, and is supported by, the upper concave surface of said horizontally disposed support collar;

a releasable, hinged, two-piece cylindrical slide clamp having a bushing mounted thereon for pivotal connection with the pair of axially aligned hinge cylinders of the slide clamp attachment boss, wherein a hinge of the hinged, two-piece cylindrical slide clamp is mounted on one side surface thereof, means for releasably closing the hinged, two-piece cylindrical slide clamp being mounted thereto on an opposed side surface, the releasable, hinged, two-piece cylindrical slide clamp slidably retaining the filling lance in a horizontal configuration, and when released, allowing the filling lance to be removed by a user for maintenance/replacement;

a first locking member mounted on the height adjustable support member, locking the lance into a user-selectable container filling height; and a second locking member securing the lance to the horizontally disposed support collar and the height adjustable support member, the second locking member locking the horizontal configuration of the lance.

2. The industrial container filling lance according to claim 1, wherein the base comprises an X-shaped member facilitating stable placement on a supporting surface.

3. The industrial container filling lance according to claim 1, further comprising angled support braces extending from the base and attached to the vertically extending support member.

4. The industrial container filling lance according to claim 1, further comprising a manually operable ball valve attached inline with the lance, the ball valve regulating fluid flow through the lance.

* * * * *